US008047387B2

(12) United States Patent
Chalekian et al.

(10) Patent No.: US 8,047,387 B2
(45) Date of Patent: Nov. 1, 2011

(54) APPARATUS AND METHODS FOR CARRYING A BOTTLE

(75) Inventors: Adam Chalekian, Racine, WI (US); Aaron Chalekian, Minneapolis, MN (US)

(73) Assignee: Tote One, LLC, Carson City, NV (US)

( * ) Notice: Subject to any disclaimer, the term of this patent is extended or adjusted under 35 U.S.C. 154(b) by 495 days.

(21) Appl. No.: 12/077,371

(22) Filed: Mar. 19, 2008

(65) Prior Publication Data

US 2008/0245763 A1 Oct. 9, 2008

Related U.S. Application Data

(63) Continuation-in-part of application No. 11/732,561, filed on Apr. 4, 2007, now abandoned.

(60) Provisional application No. 60/855,044, filed on Oct. 30, 2006.

(51) Int. Cl.
*B65D 45/24* (2006.01)

(52) U.S. Cl. ..... 215/305; 215/200; 215/295; 215/284; 220/764

(58) Field of Classification Search ..... 215/305, 215/200, 295, 284; 220/764
See application file for complete search history.

(56) References Cited

U.S. PATENT DOCUMENTS

| | | | |
|---|---|---|---|
| 235,280 | A | 12/1880 | Norton |
| 1,289,947 | A | 12/1918 | Spengler |
| 1,573,373 | A | 2/1926 | Cassell et al. |
| 2,154,581 | A | 4/1939 | Pershall |
| 2,168,822 | A | 8/1939 | Fink |
| 2,184,404 | A | 12/1939 | Stricker |
| 2,362,523 | A | 11/1944 | Armstrong, Jr. et al. |
| 2,610,081 | A | 9/1952 | Bushman |
| 2,635,604 | A | 4/1953 | Fredrickson |
| 2,789,717 | A | 4/1957 | Demke |
| 2,958,439 | A | 11/1960 | Yochem |
| 3,171,574 | A | 3/1965 | Simms |
| 3,199,707 | A | 8/1965 | Folkman |
| 3,307,752 | A | 3/1967 | Anderson |
| 3,407,956 | A | 10/1968 | Linkletter et al. |
| 3,441,172 | A | 4/1969 | Dike |
| 3,866,782 | A | 2/1975 | Westfall |
| 4,045,070 | A | 8/1977 | Geisinger |
| 4,372,454 | A | 2/1983 | Thompson |
| 4,395,378 | A | 7/1983 | Alberghini et al. |
| D273,463 | S | 4/1984 | Morris |
| 4,456,135 | A | 6/1984 | Beekes |

(Continued)

FOREIGN PATENT DOCUMENTS

| | | | |
|---|---|---|---|
| EP | 0 732 187 | A1 | 9/1996 |

(Continued)

*Primary Examiner* — Anthony Stashick
*Assistant Examiner* — Cynthia Collado
(74) *Attorney, Agent, or Firm* — Clise, Billion & Cyr, P.A.; Richard E. Billion

(57) ABSTRACT

Apparatus and associated methods for carrying and manipulation of bottles are presented herein. The apparatus may include a closure that may be sealably secured to a bottle. The apparatus may further include a movable handle attached to the closure with portions of the movable handle received in a recess defined by the bottle. The movable handle may be locatable between at least a first position and a second position. The methods may include providing a closure and a movable handle, attaching the movable handle to the closure, and locating the movable handle in at least the first position and the second position.

21 Claims, 5 Drawing Sheets

U.S. PATENT DOCUMENTS

| | | | | |
|---|---|---|---|---|
| 4,534,481 | A | 8/1985 | Summers et al. | |
| 4,629,598 | A | 12/1986 | Thompson | |
| 4,746,027 | A | 5/1988 | Coker | |
| 4,834,252 | A | 5/1989 | Crisci | |
| 4,842,158 | A | 6/1989 | Reyes, Jr. | |
| 5,078,291 | A * | 1/1992 | Gilmour | 215/284 |
| 5,086,937 | A | 2/1992 | Robinson | |
| 5,150,528 | A | 9/1992 | Shire | |
| 5,244,113 | A | 9/1993 | Stymiest | |
| 5,325,982 | A | 7/1994 | Cobb, Jr. | |
| 5,328,069 | A | 7/1994 | Cohanfard | |
| 5,409,749 | A | 4/1995 | Uehara et al. | |
| 5,487,482 | A | 1/1996 | Rocheleau | |
| 5,695,084 | A | 12/1997 | Chmela et al. | |
| 5,791,505 | A | 8/1998 | Gilliland | |
| D403,242 | S | 12/1998 | Edwards | |
| 5,862,929 | A | 1/1999 | Takeuchi et al. | |
| 6,196,403 | B1 | 3/2001 | Yamaguchi | |
| 6,364,385 | B1 | 4/2002 | Steward et al. | |
| 6,454,110 | B1 | 9/2002 | Takeuchi et al. | |
| 6,494,341 | B2 * | 12/2002 | Perkins et al. | 220/764 |
| 6,766,917 | B1 | 7/2004 | Blewitt, III | |
| 6,880,714 | B2 | 4/2005 | Blanchester | |
| 2002/0084240 | A1 * | 7/2002 | Yu-Hsien | 215/258 |
| 2006/0255036 | A1 | 11/2006 | Chau | |

FOREIGN PATENT DOCUMENTS

| | | |
|---|---|---|
| GB | 2 272 209 | 5/1994 |

* cited by examiner

APPARATUS AND METHODS FOR CARRYING A BOTTLE

CROSS-REFERENCE TO RELATED APPLICATIONS

The present application is a continuation-in-part of U.S. patent application Ser. No. 11/732,651 filed Apr. 4, 2007 now abandoned, which, in turn, claims the benefit and priority of U.S. provisional patent application 60/855,044 filed Oct. 30, 2006. U.S. patent application Ser. Nos. 11/732,651 and 60/855,044 are hereby incorporated herein by reference in their entirety.

BACKGROUND OF THE INVENTION

1. Field of the Invention

The present inventions relate to apparatus that allow for sealing, carrying, and manipulation of the bottle.

2. Description of the Related Art

Users frequently carry bottles of various beverages including sports drink, waters, and soft drinks about, for example, while engaging in various athletic and outdoor activities. The user may carry the bottle by hand, which may interfere with the activity because the user must set the bottle down in order to engage in certain activities and must keep track of the bottle. In addition, bottles can be unwieldy. Some beverage bottles may contain around two liters of liquid, and it may be difficult to manipulate the bottle, for example, to withdraw the liquid from the bottle by pouring. It may be desirable to carry bottles having a variety of other contents about, as well. These bottles may also be unwieldy making the bottles difficult to manipulate. Therefore, a need exists for apparatus and methods that may assist a user in carrying and manipulating bottles.

SUMMARY OF THE INVENTIONS

Apparatus and methods in accordance with the present inventions may resolve many of the needs and shortcomings discussed above and will provide additional improvements and advantages that may be recognized by those of ordinary skill in the art upon review of the present disclosure.

Apparatus is provided herein that includes a closure. The apparatus in various aspects, includes a closure and a movable handle, The closure is configured to be substantially sealingly secured to a bottle to retain contents within the bottle. The apparatus, in various aspects, includes a movable handle. The movable handle is hingedly attached to the closure, and the movable handle is indexably positionable between at least a first position and a second position. The movable handle in the first position is adapted to be received at least in part within a recess defined by a portion of a bottle outer surface of the bottle with at least a portion of the first surface defined by the movable handle biased against at least a portion of the portion of the bottle outer surface that defines the recess.

Methods are provided herein. The methods, in various aspects, include locating a movable handle attached to a closure sealingly secured to a bottle indexably between at least a first position and a second position, and receiving at least a portion of the movable handle in the first position within a recess defined by a portion of a bottle outer surface of the bottle.

Other features and advantages of the invention will become apparent from the following detailed description, and from the claims.

Figure 1A:
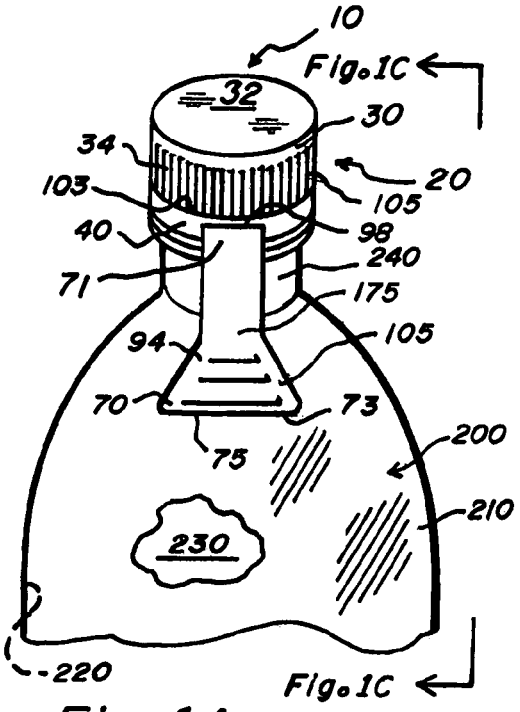
FIG. 1A illustrates a perspective view of an exemplary embodiment of an apparatus in accordance with aspects of the present inventions.

All Figures are illustrated for ease of explanation of the basic teachings of the present invention only. The extensions of the Figures with respect to number, position, relationship and dimensions of the parts to form the preferred embodiment will be explained or will be within the ordinary skill of the art after the following description has been read and understood. Further, the exact dimensions and dimensional proportions to conform to specific force, weight, strength, and similar requirements for various applications will likewise be within the ordinary skill of the art after the following description has been read and understood.

Where used in various Figures of the drawings, the same numerals designate the same or similar parts. Furthermore, when the terms "upper," "lower," "right," "left," "forward," "rear," "first," "second," "inside," "outside," "front," "back," and similar terms are used, the terms should be understood to reference only the structure shown in the drawings and utilized only to facilitate describing the illustrated embodiments.

DETAILED DESCRIPTION OF THE INVENTIONS

An apparatus and associated methods for sealing, carrying, and manipulation of bottles are disclosed herein. The apparatus may include a closure that may be secured to the bottle to seal the bottle in order to secure the contents within the bottle. The apparatus may further include a movable handle secured to the closure. The movable handle may be locatable between at least a first position and a second position. When the apparatus is secured to the bottle and the movable handle is located in the first position, the movable handle may be generally oriented proximate the bottle, and, in some aspects, may be biased against portions of the bottle outer surface to minimize interference with distribution through normal commercial channels. In the second position, the movable handle may extend generally outward and/or upward from the bottle, for example, to allow the user to apprehend the bottle by the movable handle to carry the bottle and to manipulate the bottle including pouring, handling, and passing the bottle about.

The Figures generally illustrate exemplary embodiments of the apparatus. The particularly illustrated embodiments of the apparatus have been chosen for ease of explanation and understanding. These illustrated embodiments are not meant to limit the scope of coverage but, instead, to assist in understanding the context of the language used in this specification and in the appended claims. Accordingly, the appended claims may encompass variations of the apparatus and methods that differ from the illustrated embodiments.

With reference generally to the Figures, the apparatus 10 may include the closure 20 securable to the bottle 200 to secure the contents within the bottle 200, and the apparatus 10 may include the movable handle 70 which is locatable between at least a first position 94 and a second position 96. The closure 20 and the movable handle 70 may be made of molded plastics or other materials including biodegradable materials and combinations of materials and made by various manufacturing processes, as would be readily recognized by those of ordinary skill in the art upon review of this disclosure.

The bottle 200 defines and bottle outer surface 210, an bottle inner surface 220, and the bottle inner surface 229 may define a chamber 230 adapted to contain the contents such as a liquid, a powder, or other bulk materials. The bottle 200 may define at least one aperture 250 through which the contents may be received into the chamber 230 and through which the contents may be withdrawn from the chamber 230. The bottle 200 may include a bottleneck 240, which is a portion of the bottle 200 that generally defines the aperture 250. In various aspects, the bottleneck 240 extends forth from a bottle shoulder 245 of the bottle 200.

The bottleneck 240 may be configured with a detent 260 such as threads or a lip to engage at least portions of the closure 20 to secure sealingly the closure 20 over the aperture 250 in order to retain the contents within the chamber 230. The bottleneck 240 may further define a flange 44 which may be a raised portion molded from the bottle material that extends circumferentially about the bottleneck 240. The bottle 200 may be of various shapes and sizes and may be made of glass, various plastics, or other materials or combinations of materials, and may be molded by various molding processes or otherwise formed, as would be recognized by those of ordinary skill in the art upon review of this disclosure.

The closure 20 may be configured to be secured removably over the aperture 250 to seal the aperture 250 in order to retain the contents within the chamber 230 of the bottle. In various aspects, the closure 20 may be configured to engage various detents 260 on the bottleneck 240. In various aspects, the closure 20 may be configured to engage threadably the detent 260 on the bottleneck 240 or to engage snappably the detent 260 on the bottleneck 240. In various aspects, the closure 20 may include a cap 30 that defines at least an upper surface 32 and a peripheral surface 34. The portion of the cap 30 that defines the upper surface 32 may occlude the aperture 250 when the cap 30 is secured to the bottle 200. In various aspects, the portion of the cap 30 that define the peripheral surface 34 may be configured to surround portions of the bottleneck 240 and to be secured to the detent 260 so that the cap 30 may be generally sealingly secured to the bottle 200 in order to generally sealing occlude the aperture 250. In various aspects the cap 30 may be configured to engage threadably the detent 260 on the bottleneck 240 or to engage snappably the detent 260 on the bottleneck 240 to occlude the aperture 250. In some aspects, the closure 20 may be configured to be removable so that the closure 20 may be disengaged from the bottleneck 240 in order to allow the contents to be withdrawn from the chamber 230, while, in other aspects, the closure 20 may be configured to be generally secured about the bottleneck 240 with the closure 20 including other features to allow the contents to be withdrawn from the bottle 200. At least a portion of the peripheral surface 34, in various aspects, may be configured as grippable surface 105 to allow user to apprehend the cap 30 in order to disengage the cap 30 from the detent 260.

The closure 20 may, in some aspects, include a base ring 40, with the base ring 40 disposed circumferentially about the bottleneck 240. In various aspects, the base ring may be disposed about the bottleneck generally between the flange 44 and the aperture 250. In various aspects, portions of the cap 30 such as the portions that define the peripheral surface 34 may be engaged with portions of the base ring 40. The cap 30, in various aspects, may be engages with the base ring 40 along a frangible breakline 103, with the frangible breakline 103 adapted such that the cap 30 may be disengaged from the base ring 40 along the frangible breakline 103. The base ring 40 may help secure the cap 30 to the bottle 200 to occlude the aperture 250. In various aspects, the frangible breakline 103 may be broken by removal of the cap 30 from the bottle 200, which may provide indications that the bottle 200 has been opened or other tampering. Portions of the base ring 40, in some aspects, may be biased against portions of the flange 44. In other aspects, portions of the cap 30 such as the portions that define the peripheral surface 34 may be adapted to be biased against portions of the flange 44.

In various aspects, the closure 20 may include a flange ring 46, and the flange ring 46 may be disposed circumferentially about the bottleneck 240 generally between the flange 44 and the bottle shoulder 245 such that the flange 44 retains the flange ring 46 upon the bottleneck 240.

In various aspects, the closure 20 may include a nipple structure 50 configured into the cap 30. The nipple structure 50 typically includes a nipple 52 moveable between a first nipple position 54 and a second nipple position 56. With the cap 30 secured to the bottle 200 and the nipple 52 in the first nipple position 54, the contents are generally secured within the chamber 230. When the nipple 52 is placed in the second nipple position 56, the contents may be withdrawn through one or more ports 69 defined by the nipple structure 50. The nipple structure 50 may be configured into a portion of the upper surface 32 of the cap 30.

In various aspects, the closure 20 may include a flip top 62 configured into the cap 30 that allows the contents to be retained within the chamber 230 or withdrawn from the chamber 230. The flip top 62 may, in some aspects, be hingedly secured to portions of the closure 20 by a flip top hinge 67 and movable between a first top position 64 and a second top position 66. In the first top position 64, portions of the flip top 62 may securably engage other portions of the closure to occlude one or more ports 69 in order to secure the contents within the chamber 230 of the bottle 200. The portions of the flip top 62 may be disengaged from portions of the closure 20 so that the flip top 62 may be positioned in the second top position 66. In the second top position 66, the one or more ports 69 are revealed, so that the contents may be withdrawn through the one or more ports 69. The flip top 62, in other aspects, may be configured to removably engage structures on portions of the closure 20 so that one or more ports 69 are occluded when the flip top 62 is engaged and one or more ports 69 are revealed when the flip top 62 is disengaged.

The closure 20, in various aspects, may include various combinations of the cap 30, base ring 40, and flange rings 46. The closure 20 may include nipple structures 50, flip tops 62, and other structures to allow removal of the contents. The closure 20 may be configured to engage various detents 260 on the bottle 200 in various aspects, and, in various aspects, the closure 20 may be configured with various combinations of structures to engage the bottle 200. The closure 20 may be configured in other ways and combinations of ways as would be recognized by those of ordinary skill in the art upon review of this disclosure.

The movable handle defines a first end 71 and a second end 73, and a first surface 173, a second surface 175, and a handle periphery 177. The first end 71 of the movable handle may be attached to the closure 20 to aid the user in carrying and manipulating the bottle 200, and, in various aspects, the first surface 173 may be generally oriented toward the bottle outer surface 210 of the bottle 200, the second surface 175 may be generally oriented away from the bottle outer surface 210, and the handle periphery 177 may be defined by the periphery of the handle 70, for example, the extremity of the movable handle 70 between the first surface 173 and the second surface 175. In some aspects, the first end 71 of the movable handle 70 may be attached to the peripheral surface 34 of the cap 30. In other aspects, the first end 71 of the movable handle 70 may be attached to the base ring 40, which would allow the movable handle 70 to swivel about the bottleneck 240 when the base ring 40 is detached from the cap 30. In still other aspects, the first end 71 of the movable handle 70 may be attached to the flange ring 46.

When attached to the closure 20, the movable handle 70 is configured to be locatable between at least a first position 94 and a second position 96. In the first position 94, at least portions of the movable handle 70 may be generally proximate the bottle surface 210 of the bottle 200 in order to prevent the movable handle 70 from interfering with distribution of the bottle 200 in commerce including, for example, shipment, aggregation, stowage, and storage of the bottle 200. In various aspects, portions of the movable handle 70 including at least portions of the first surface 173 may be generally biased against portions of the bottle outer surface 210 when the movable handle 70 is located in the first position 94. In various aspects, the movable handle 70 may include curved portions 76 or other geometric shapes in conformance to the shape of the bottle outer surface 210 in order to be generally biased against portions of the bottle outer surface 210 when the movable handle 70 is located in the first position 94. The movable handle 70 may also include straight portions 77 in some aspects, and the straight portions 77 may also generally conform to portions of the bottle outer surface 210.

Portions of the bottle outer surface 210 of the bottle 200, in various aspects, may define a recess 212 adapted to receive generally at least portions of the movable handle 70 when the movable handle 70 is located in the first position 94. The recess 212 may be defined by portions of the bottle shoulder 245, by portions of the bottleneck 240, by combinations thereof, and otherwise defined by portions of the bottle outer surface 210 of the bottle 200. The recess 212 may generally conform to the shape of portions of the handle peripheral surface 177 and may otherwise be configured such that, in the first position 94, portions of the first surface 173 may be generally biased against portions of the bottle outer surface 210 within the recess 212 and the movable handle 70 may be at least partly received within the recess 212 in order to minimize the profile of the movable handle 70 with respect to the bottle 200. In various aspects, the recess 212 and the movable handle 70 may be configured such that the second surface 175 is generally aligned with the bottle outer surface 210 when the movable handle 70 is in the first position 94 in order to minimize the profile of the combined bottle 200 and movable handle 70.

In the second position 96, the movable handle 70 may extend generally outward from the bottle 200 to allow the user to apprehend the bottle 200 by the movable handle 70. With the movable handle 70 in the second position 96, the user may grasp the movable handle 70 to carry the bottle 200 and to manipulate the bottle 200 including, for example, pouring, handling, and passing the bottle 200 about. In various aspects, the movable handle 70 may define one or more loops 72 generally proximate the second end 73 through which, for example, the user's fingers, the user's hand, a strap, a clip 74, or suchlike may be inserted to secure the bottle 200, to carry the bottle 200, or to manipulate the bottle 200. At least portions of the movable handle 70 may be configured with a grippable surface 105, which may be generally proximate the second end 73, to aid the user in grasping the movable handle 70. In various aspects, the movable handle 70 may be configured to include the clip 74 including clasps and various fasteners that may allow the movable handle 70 to be secured about a person such as to a backpack or to a belt loop. In various aspects the movable handle 70 may include a flared portion 75, which may aid the user in gripping the movable handle 70.

In various aspects, the movable handle 70 generally proximate the first end 71 may be attached to the closure 20, at least in part, by a hinge 98. In various aspects, the hinge 98 may be a living hinge 101, which may allow for efficient manufacture of the closure 20 with attached movable handle 70. The living hinge 101 includes, but is not limited to, a feature that creates bi-stable positioning. Bi-stable may be defined as being in a neutral energy state in two positions. When the living hinge 101 is positioned between the two neutral energy state positions, the living hinge 101 wants to move to one or the other of the two neutral energy state positions. Accordingly, this provides a mechanism of locating. In various aspects, the hinge 98 may be a pinned hinge 107, a pivot hinge, a butterfly hinge, or other hinge or combination of hinges or similar features that allow the movable handle 70 to be located between at least a first position 94 and a second position 96 as would be recognized by those of ordinary skill in the art upon review of this disclosure. The movable handle 70 and the closure 20 may be configured in various aspects such that the movable handle 70 may be indexed into at least the first position 94 and the second position 96.

In operation, the closure 20 portion of the apparatus 10 may be sealingly secured to the detent 260 on the bottleneck 240 in order to generally retain the contents within the bottle 200. The movable handle 70 may be located in the first position 94 so that the bottle 200 may be aggregated with other bottles 200 to minimize interference by the movable handle 70 with distribution. The user may then locate the movable handle 70 in the second position 96 in order to use the movable handle 70 to carry or manipulate the bottle 200. For example, in some aspects the user may insert one or more fingers through the loop 72 defined by the movable handle 70 in order to carry the bottle 200. As another example, the user may secure the loop 72 defined by the movable handle 70 to the clip 74 that is, in turn, attached to, for example, a belt loop or to a strap secured to a backpack in order to carry the bottle 200. As a further example, in various aspects, the user may use the movable handle 70 to manipulate at least the bottleneck 240 portion of the bottle 200 during withdrawal of at least portions of the contents.

Specific embodiments of the apparatus 10 are illustrated in the Figures. FIGS. 1A to 1D illustrate the apparatus 10 including the closure 20 and the movable handle 70 in conjunction with the bottle 200. In FIG. 1A, the closure 20 is secured to the bottleneck 240. The closure 20 in this embodiment includes the cap 30 and the base ring 40. The cap 30 may be secured to the base ring 40 along the frangible breakline 103, as illustrated. The cap 30 may be twisted, in this embodiment, to separate the cap 30 from the base ring 40 along the frangible breakline 103, and the cap 30 may then be removed from the bottleneck 240 so that contents may be withdrawn from the bottle 200.

In the embodiment of FIG. 1A, the first end 71 of the movable handle 70 is attached to the base ring 40 by the hinge 98, and the movable handle 70 is illustrated as located in the first position 94. The movable handle 70 includes the flared portion 75 generally proximate the second end 73. The flared portion 75 in this embodiment is configured with the grippable surface 105 in order to aid the user in apprehending the movable handle 70. Because the movable handle 70 is secured to the base ring 40 in this embodiment, the movable handle 70 remains attached to the bottle 200 when the cap 30 has been removed from the bottleneck 240. Accordingly, after removal of the cap 30, the user may use the movable handle 70 to manipulate the bottle 200, for example, in order to withdraw at least a portion of the contents from the bottle 200 by pouring.

Figure 1B:
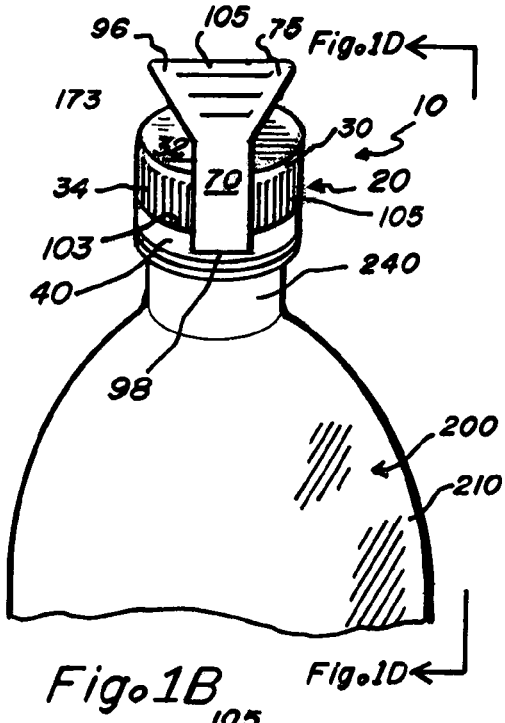
FIG. 1B illustrates another perspective view of an exemplary embodiment of an apparatus in accordance with aspects of the present inventions.

FIG. 1B illustrates the movable handle 70 located in the second position 96. The movable handle 70 is attached to the base ring 40 by hinge 98, in this embodiment, to allow the movable handle 70 to be located in at least the first position 94 and the second position 96. The movable handle 70 may be variously configured with features such as the flared portion 75 with grippable surface 105 in this illustrated embodiment, which may aid the user's ability to grip the movable handle 70.

Figure 1C:
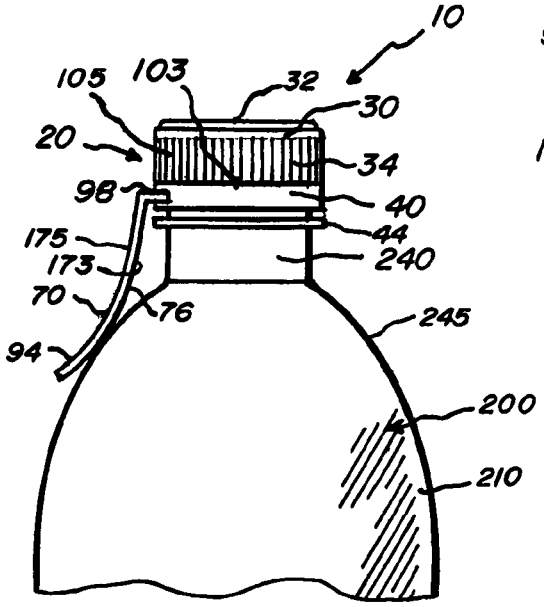
FIG. 1C illustrates another perspective view of an exemplary embodiment of an apparatus in accordance with aspects of the present inventions.

In the embodiment illustrated in FIG. 1C, the movable handle 70 is located in the first position 94. The movable handle 70 may be configured to lie proximate the bottle outer surface 210 of the bottle 200 by, for example, including the curved portion 76, as illustrated. In this illustration, portions of the first surface 173 of the movable handle 70 are biased against portions of the bottle outer surface 210 generally proximate the bottle shoulder 245. In other implementations, at least portions of the first surface 173 of the movable handle 70 may be generally biased against portions of the bottle outer surface 210 including portions of the bottle shoulder 245, portions of the bottleneck 240, other portions of the bottle outer surface 210 and combinations thereof, as would be recognized by those of ordinary skill in the art upon review of this disclosure.

Attachment of the movable handle 70 to the base ring 40, as illustrated in FIGS. 1A to 1D, may facilitate locating the movable handle 70 proximate the bottle outer surface 210 in the first position 94. This may minimize interference by the movable handle 70 in order to facilitate commercial distribution of bottles 200 to which the apparatus 10 is secured. Configuring the movable handle 70 with various curvatures may also aid the user in apprehending the movable handle 70, and may aid in carrying and manipulating the bottle 200.

Figure 1D:
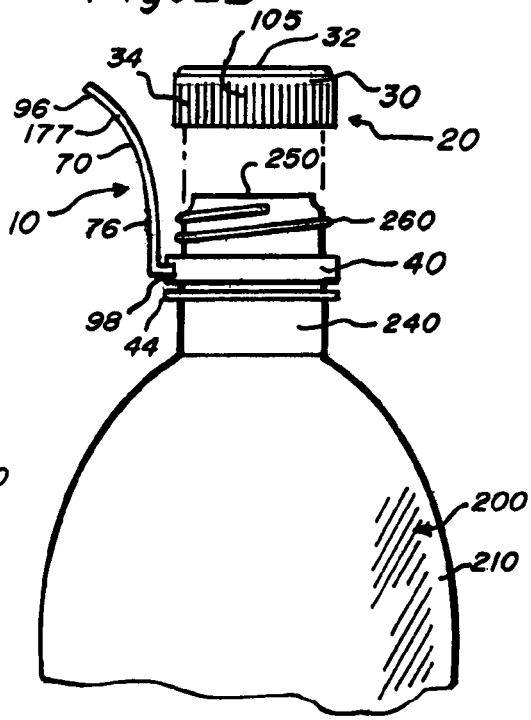
FIG. 1D illustrates another perspective view of an exemplary embodiment of an apparatus in accordance with aspects of the present inventions.

In FIG. 1D, the cap 30 portion of the closure 20 has been removed while the base ring 40 portion of the closure 20 remains secured about the bottleneck 240. The cap 30, in this embodiment, has been configured to be removably secured to the detent 260 configured as a set of threads on the bottle 200 neck. With the cap 30 removed, contents may be withdrawn from the bottle 200 through the aperture 250. The movable handle 70 is attached to the base ring 40 by the hinge 98, and the movable handle 70 is located in the second position 96, as illustrated. The user may grasp the bottle 200, at least in part, by the movable handle 70 in order to manipulate the bottle 200 while, for example, withdrawing the contents through the aperture 250 by pouring.

Figure 2A:
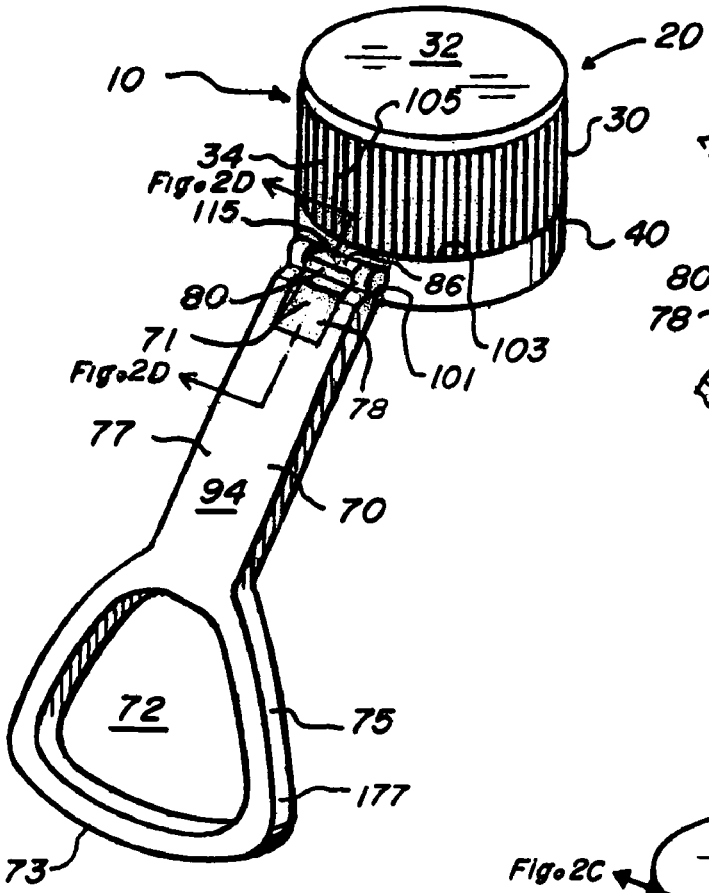
FIG. 2A illustrates a perspective view of an exemplary embodiment of an apparatus in accordance with aspects of the present inventions.

An embodiment of the apparatus 10 is illustrated in FIG. 2A including the closure 20 and the movable handle 70. In this embodiment, the closure 20 includes the cap 30 and the base ring 40. The first end 71 of the movable handle 70 is attached to the base ring 40 by the hinge 98 configured as a living hinge 101. The movable handle 70, in this embodiment, is configured to define the loop 72 through which, for example, a finger, a strap, or a hook could pass to grasp or to secure the movable handle 70, and, hence, the bottle 200.

As illustrated in FIG. 2A, the movable handle 70 is located in the first position 94. The movable handle 70, as illustrated, includes a stop 78 that engages stop block 80, which is included on the base ring 40, so that the position of the movable handle 70 may be indexed. In order to index the position of the movable handle 70, the stop block 80 defines a first click point 84 and a second click point 86. When the stop 78 engages the stop block 80 at the first click point 84, the movable handle 70 is generally located in the first position 94 to be generally secured in the first position 94. The stop 78 may be disengaged from the first click point 84 and engaged with the stop block 80 at the second click point 86 so that the movable handle 70 is generally located in the second position 96 to be generally secured in the second position 96. The movable handle 70 could be indexed so that the movable handle 70 may be located in a plurality of positions in various embodiments by including a plurality of stop blocks 80 to define a plurality of click points. The movable handle 70 could then be indexed among the plurality of click points defined by the plurality of stop blocks 80. The movable handle 70 could be indexed in other ways in various embodiments as would be recognized by those of ordinary skill in the art upon review of this disclosure.

Figure 2C:
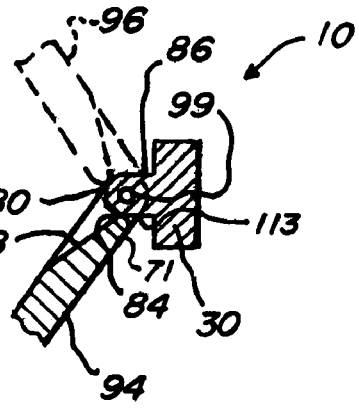
FIG. 2C illustrates in cross-section a portion of the exemplary embodiment of the apparatus according to the present inventions illustrated in FIG. 2B.
Figure 2D:
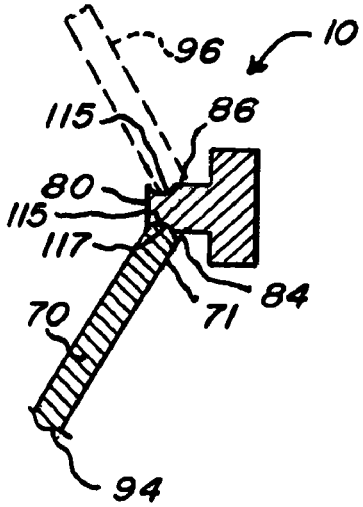
FIG. 2D illustrates in cross-section a portion of the exemplary embodiment of the apparatus according to the present inventions illustrated in FIG. 2A.
Figure 2B:
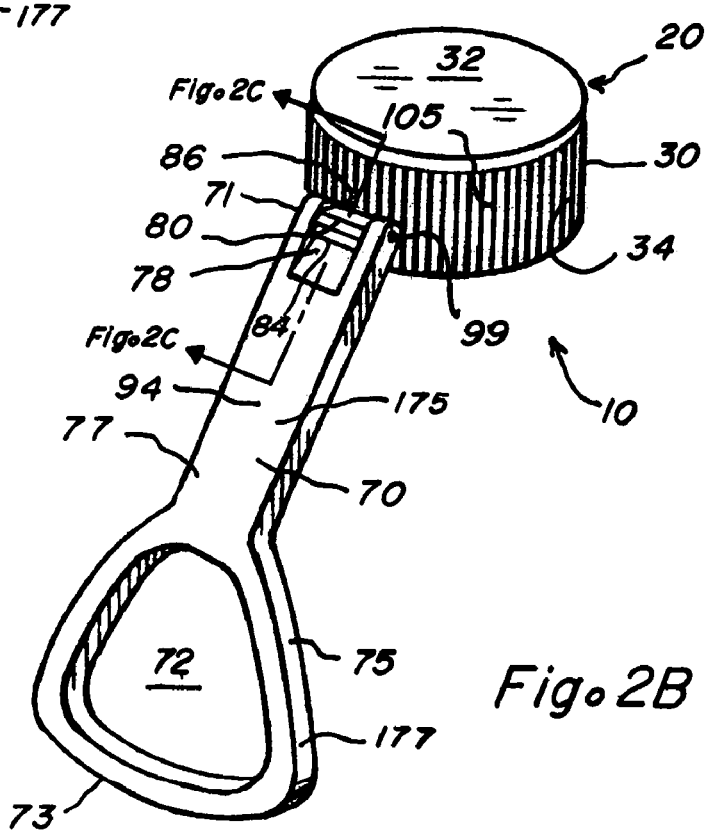
FIG. 2B illustrates a perspective view of another exemplary embodiment of an apparatus in accordance with aspects of the present inventions.

Another embodiment of the apparatus 10 is illustrated in FIG. 2B, including the closure 20 and the movable handle 70. The movable handle 70 is secured to the closure 20, as illustrated by attachment to the peripheral surface 34 defined by the cap 30. The hinge 98 is configured as a pinned hinge 107 rotatable about hinge pins 99 in this illustrated embodiment. The movable handle 70, in this embodiment, defines loop 72 through which, for example, a finger, a strap, or a hook could pass to grasp or to secure the movable handle 70.

The movable handle 70 is illustrated in the first position 94 in FIG. 2B. The movable handle 70, as illustrated, includes a stop 78 that engages stop block 80, which is included on the peripheral surface 34 of cap 30, so that the position of the movable handle 70 may be indexed. The stop block 80 defines a first click point 84 and a second click point 86. When the stop 78 engages the stop block 80 at the first click point 84, the movable handle 70 is generally located in the first position 94 to be generally secured in the first position 94. The stop 78 may be disengaged from the first click point 84 and engaged with the stop block 80 at the second click point 86 so that the movable handle 70 is generally located in the second position 96 to be generally secured in the second position 96. The movable handle 70 could be indexed between a plurality of positions in various embodiments by including a plurality of stop blocks 80 to define a plurality of click points. The movable handle 70 could then be indexed among the plurality of click points defined by the plurality of stop blocks 80.

FIG. 2C illustrates in cross-section a detail of the attachment of the movable handle 70 to the peripheral surface 34 in the embodiment illustrated in FIG. 2B. As can be seen, the first end 71 of the movable handle 70 may engage the stop block 80 at the first click point 84 to generally locate the movable handle 70 in the first position 94. As illustrated in phantom, the first end 71 of the movable handle 70 may engage the stop block 80 at the second click point 86 to generally locate the movable handle 70 in the second position 96. In this embodiment, the first end 71 of the movable handle is generally configured with a substantially flat nose 111 that engages the first click point 84 and the second click point 86, which are also configured with corresponding substantially flat surfaces 113.

FIG. 2D illustrated in cross-section a detail of the attachment of the movable handle 70 to the peripheral surface in the embodiment illustrated in FIG. 2A. As can be seen, the first end 71 of the movable handle 70 may engage the stop block 80 at the first click point 84 to generally locate the movable handle 70 in the first position 94, and may engage the stop block 80 at the second click point 86 to generally locate the movable handle 70 in the second position 96. Accordingly, the movable handle 70 may be indexed between the first position 84 and the second position 86. In this embodiment, the first click point 84 and the second click point 86 of the stop block 80 are configured as a pocket 115. The first end 71 of the movable handle 70 is configured with a bull nose 117 that corresponds to the pocket 115 so that the movable handle 70 may locate into the pocket 115 at the first click point 84 and at the second click point 86.

Figure 3:
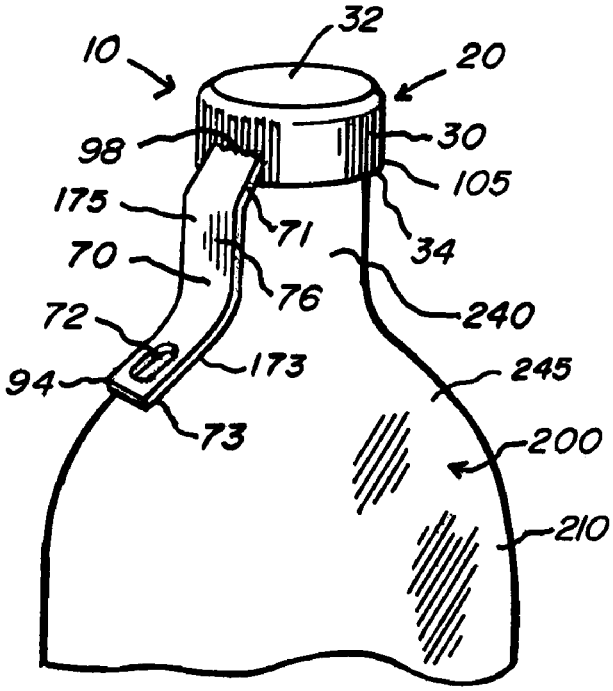
FIG. 3 illustrates a perspective view of an exemplary embodiment of an apparatus in accordance with aspects of the present inventions.

FIG. 3 illustrates an embodiment of the apparatus 10 secured to the bottleneck 240 of the bottle 200. In this embodiment, the closure 20 apparatus 10 includes the cap 30. The first end 71 of the movable handle 70 is attached to the cap 30 along the peripheral surface 34 by the hinge 98, so that the movable handle 70 may be located in at least a first position 94 and a second position 96. As illustrated, the movable handle 70 is located in the first position 94. The movable handle 70, in this embodiment, defines the loop 72 generally proximate the second end 73 through which, for example, a finger, a strap, or a hook could pass to grasp or to secure the movable handle 70.

The movable handle 70 may be configured to be generally biased against the bottle outer surface 210 of the bottle 200 particularly proximate the bottleneck 240 and bottle shoulder 245 by, for example, including the curved portion 76, as illustrated in FIG. 3. Attachment of the movable handle 70 to the peripheral surface 34 defined by the cap 30, as illustrated, may allow the movable handle 70 to be biased against the bottle outer surface 210. This may minimize the space required by the movable handle 70 in order to facilitate commercial distribution of bottles 200 to which apparatus 10 is secured. In other embodiments, attachment of the movable handle 70 to the base ring 40 or to the flange ring 46 may allow the movable handle 70 to be biased against the bottle outer surface 210 to minimize the space required by the movable handle 70 in the first position 94.

Figure 4A:
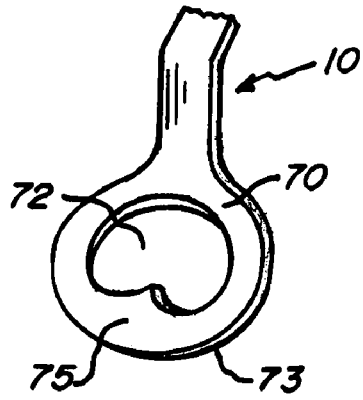
FIG. 4A illustrates a perspective view of an exemplary embodiment of portions of an apparatus in accordance with aspects of the present inventions.
Figure 4C:
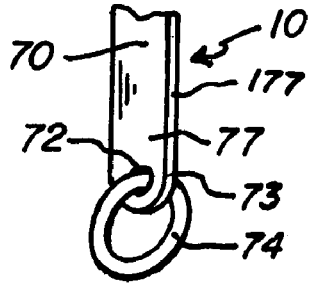
FIG. 4C illustrates a perspective view of a third exemplary embodiment of portions of an apparatus in accordance with aspects of the present inventions.
Figure 4B:
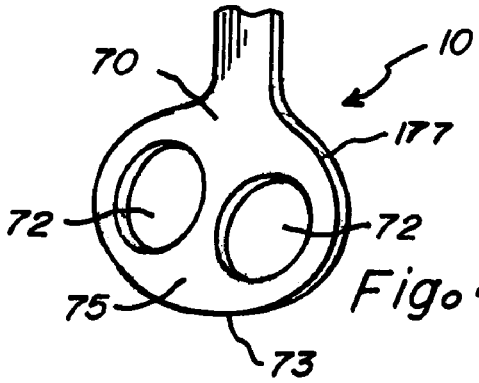
FIG. 4B illustrates a perspective view of a second exemplary embodiment of portions of an apparatus in accordance with aspects of the present inventions.
Figure 4D:
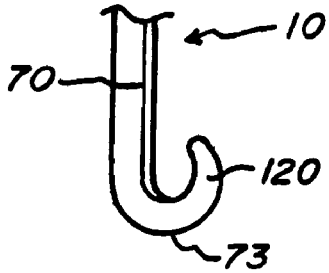
FIG. 4D illustrates a perspective view of a fourth exemplary embodiment of portions of an apparatus in accordance with aspects of the present inventions.
Figure 4E:
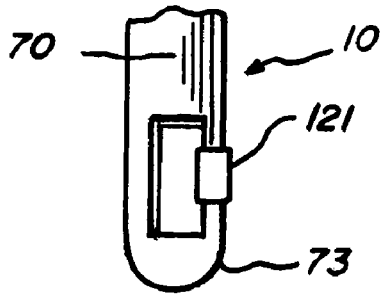
FIG. 4E illustrates a perspective view of a fifth exemplary embodiment of portions of an apparatus in accordance with aspects of the present inventions.

FIGS. 4A, 4B, 4C, 4D, and 4E illustrate embodiments of portions of the movable handle 70 of the apparatus 10. In FIG. 4A, the loop 72 defined by the movable handle 70 generally proximate the second end 73 includes curves that could accommodate two fingers in the flared portion 75. The movable handle 70 in FIG. 4B includes the flared portion 75 generally proximate the second end 73 that defines two loops 72 that could accommodate two fingers. In various embodiments, the movable handle 70 could define a plurality of loops 72 to, for example, accommodate a plurality of fingers. In FIG. 4C, the movable handle 70 includes a straight portion 77. The movable handle 70, as illustrated in FIG. 4C, defines the loop 72 and the clip 74 is passed through the loop 72 generally proximate the second end 73. FIG. 4D illustrates an embodiment of the movable handle 70 generally configured as a hook 120 proximate the second end 73. In FIG. 4E, the movable handle is generally configured to include a carabiner 121 that may be used to secure the bottle. Other embodiments of the movable handle 70 that would aid in grasping the movable handle 70 or otherwise attaching the movable handle 70 would readily be recognized by those of ordinary skill in the art upon review of this disclosure.

Figure 5A:
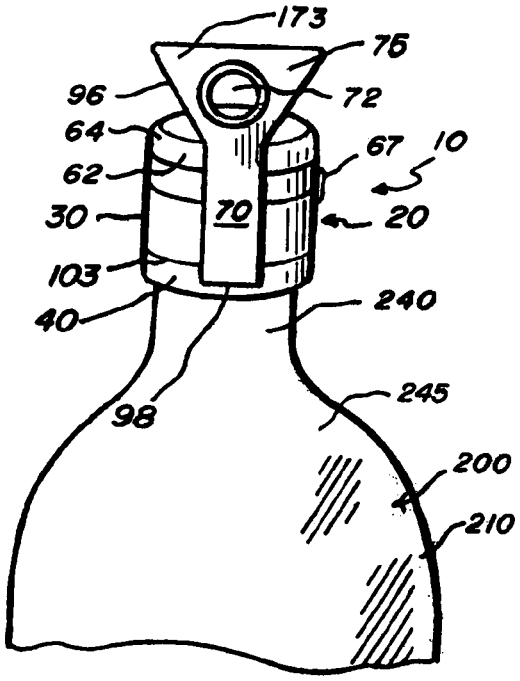
FIG. 5A illustrates a perspective view of an exemplary embodiment of an apparatus in accordance with aspects of the present inventions.
Figure 5B:
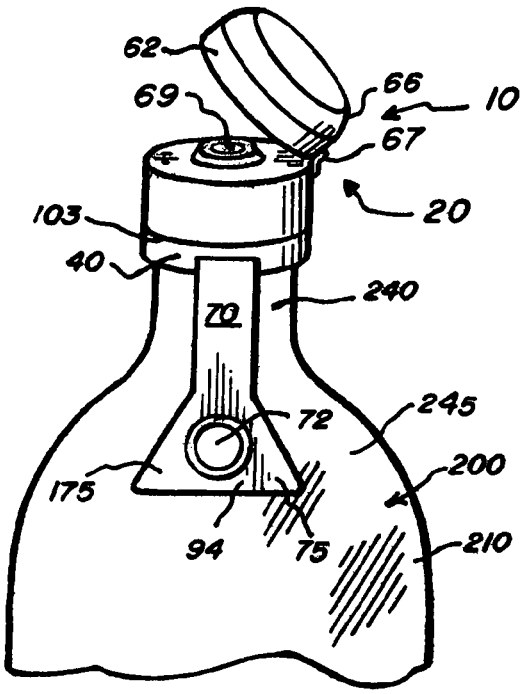
FIG. 5B illustrates another perspective view of an exemplary embodiment of an apparatus in accordance with aspects of the present inventions.

FIGS. 5A and 5B illustrate an embodiment of the apparatus 10 with the closure 20 configured with a flip top 62 and secured to the neck of the bottle 200. As illustrated in FIG. 5A, the closure 20 includes the cap 30 with the flip top 62 and the base ring 40. The cap 30 may be secured to the base ring 40 along the frangible breakline 103. The movable handle 70, in this embodiment is attached by hinge 98 to the base ring 40, and the movable handle 70 is illustrated in the second position 96. The bottle 200 may then be carried by the movable handle 70 with the movable handle 70 located in the second position 96. The cap 30 includes the flip top 62, which may be locatable between at least a first top position 64 and a second top position 66. As illustrated in FIG. 5A, the flip top 62 is located in the first top position 64 to generally secure the contents within the bottle 200.

In FIG. 5B, the flip top 62 is located in the second top position 66, which reveals the port 69 so that the contents may be withdrawn from the bottle 200 through the port. As illustrated, the flip top 62 is secured by flip top hinge 67, although the flip top 62 may be secured in other ways those of ordinary skill in the art will recognize upon review of this disclosure.

As illustrated, the movable handle 70 may be placed in the first position 94 when the flip top 62 is placed in the second top position 66 to generally prevent the movable handle 70 from interfering with the withdrawal of the contents from the bottle 200 through the port 69.

Figure 6A:
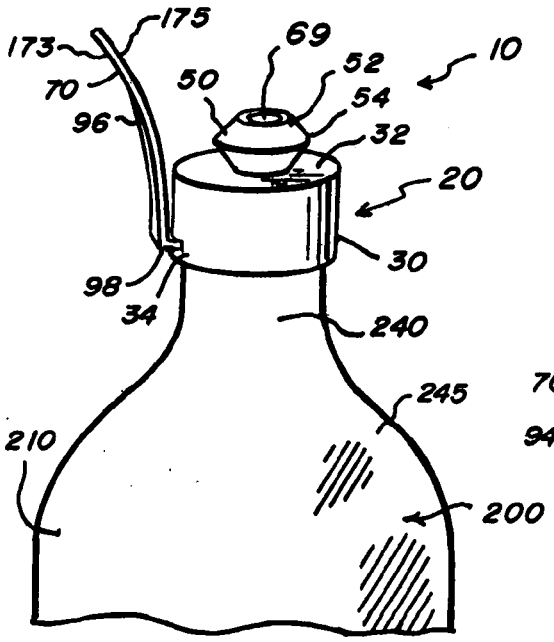
FIG. 6A illustrates a perspective view of an exemplary embodiment of an apparatus in accordance with aspects of the present inventions; and, FIG. 6B illustrates another perspective view of an exemplary embodiment of an apparatus in accordance with aspects of the present inventions.
Figure 6B:
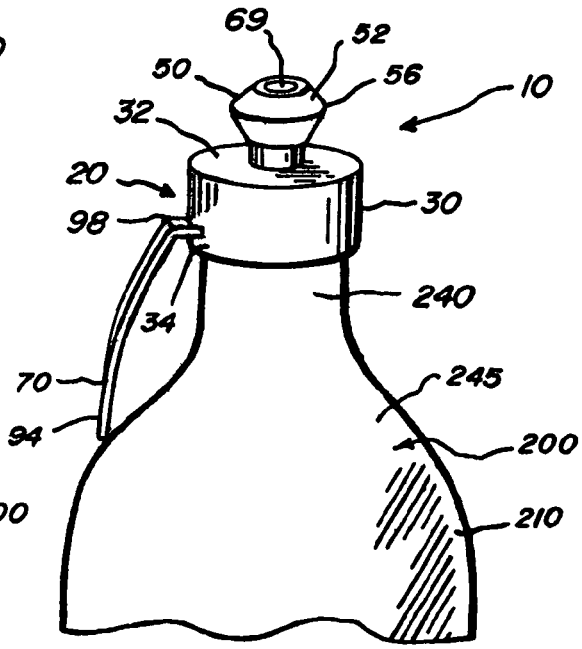

FIGS. 6A and 6B illustrate an embodiment of an apparatus 10 with the closure 20 configured with the nipple structure 50 and secured to the neck of the bottle 200. As illustrated in FIG. 6A, the closure 20 includes a cap 30 with the nipple structure 50 generally configured into the upper surface 32 of the cap 30. The movable handle 70, in this embodiment, is attached by hinge 98 to portions of the peripheral surface 34 of the cap 30, and the movable handle 70 is illustrated in the second position 96. The bottle 200 may then be carried by the movable handle 70 with the movable handle 70 located in the second position 96. The nipple structure 50 includes the nipple 52, which may be positionable between at least a first nipple position 54 and a second nipple position 56. As illustrated in FIG. 6A, the nipple 52 is positioned in the first nipple position 54 to generally secure the contents within the bottle 200.

In FIG. 6B, the nipple 52 is positioned in the second nipple position 56 to allow the contents to be withdrawn from the bottle 200 through the port 69. As illustrated, the movable handle 70 may be placed in the first position 94 so that the movable handle 70 to generally prevent the movable handle 70 from interfering with the withdrawal of the contents from the bottle 200 through the port 69.

Figure 7A:
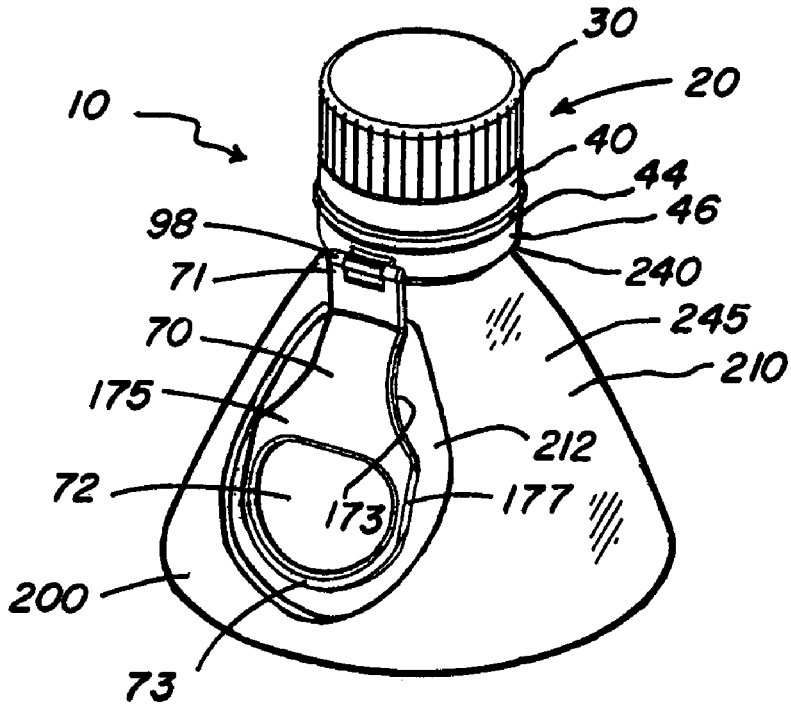
FIG. 7A illustrates by perspective view an exemplary embodiment of an apparatus in accordance with aspects of the present inventions.
Figure 7B:
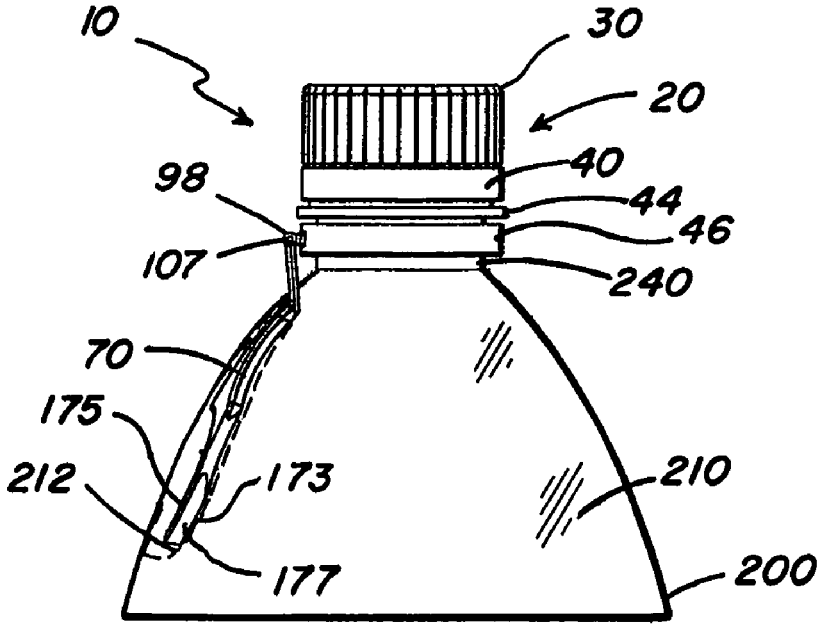
FIG. 7B illustrates by another perspective view an exemplary embodiment of an apparatus in accordance with aspects of the present inventions that generally corresponds to FIG. 7A.

FIGS. 7A and 7B illustrate an embodiment of the apparatus 10 in which the bottle outer surface 210 of the bottle shoulder 245 defines the recess 212 and the movable handle 70 is located in the first position 84. The recess 212, as illustrated, is generally configured to surround portions of the handle peripheral surface 177 generally proximate the second end 73 to allow portions of the first surface 173 proximate the second end 73 to generally bias against the bottle outer surface 210 within the recess 212 with the movable handle 70 in the first position 94 to contain at least portions of the movable handle 70 within the recess 212. The recess 212 may be formed in the bottle 200 by blow molding or other processes as would be recognized by those of ordinary skill in the art upon review of this disclosure.

In various embodiments, the bottle outer surface 210 within the recess 212 and the first surface 173 generally proximate the second end 73 may be correspondingly shaped to allow the first surface 173 to be generally biased against the bottle outer surface 210 within the recess 212. In various embodiments, the second surface 175 may lie outside of the recess 212 to be generally above the portions of the outer bottle surface 210 that surround the recess 212. The second surface 175 may generally correspond to the portions of the outer bottle surface 210 that surround the recess 212, and/or may be recessed below the portions of the outer bottle surface 210 that surround the recess 212 so as to be generally held within the recess 212. Portions of the recess are shown in phantom in FIG. 7B. As illustrated in FIG. 7B, the second surface 175 is recessed below the portions of the outer bottle surface 210 that surround the recess 212.

The movable handle 70, as illustrated in FIGS. 7A and 7B, is hingedly secured to the flange ring 46 by hinge 98 configured as a pinned hinge 107. The flange ring 46 is circumferentially disposed about the bottleneck 240 generally between the flange 44 and the bottle shoulder 245 in this embodiment. Accordingly, the flange ring 46 in this embodiment may rotate about the bottleneck 240 independent of the cap 30 and/or base ring 40 to allow the movable handle 70 to rotate about the bottle independent of the cap 30 and/or base ring 40. This may allow the bottle 200 to rotate freely about the handle 70 when being transported by the handle 70 in the second position 96 without unfastening the cap 30 and spilling contents from the bottle chamber 230.

In other embodiments, the flange ring 46 could be fixedly disposed about the bottleneck 240 to prevent rotation of the flange ring 46 about the bottleneck 240. In various embodiments, the movable handle 70 may be attached to the peripheral surface 34 of the cap 30 or may be attached to the base ring 40, and portions of the movable handle 70 disposed within recess 212 with the movable handle 70 in the first position 94. In various embodiments, the recess 212 may be defined, at least in part, by portions of the bottle outer surface 212 of the bottle shoulder 245, the bottleneck 240, other portions of the bottle surface 210, and/or combinations thereof, as would be readily recognized by those of ordinary skill in the art upon review of this disclosure.

Methods for carrying and manipulation of bottles 200 are also provided herein. The methods may include providing a closure 20 and may further include sealingly securing the closure 20 to the bottle 200 to generally secure the contents within the bottle 200. The apparatus 10 may further include providing a movable handle 70 and attaching the movable handle 70 to the closure 20. The movable handle 70 may be locatable between at least a first position 94 and a second position 96. The methods may include locating the movable handle 70 in the first position 94 to allow the bottle 200 to be distributed through commercial channels. Locating the movable handle 70 in the second position 96 to allow the user to apprehend the bottle 200 by the movable handle 70 to carry the bottle 200 and to manipulate the bottle 200 including pouring, handling, and passing the bottle 200 about may also be included in the methods. The methods may further include providing a clip 74 and securing the clip 74 to a loop 72 defined by the movable handle 70. The methods may also include configuring the movable handle 70 to facilitate gripping of the movable handle 70 by providing loops 72, flared portions 75 and grippable surfaces 105. The methods may also include configuring the movable handle 70 to define a hook 120, or configuring the movable handle to include a carabiner 121. The methods may, in various aspects, include defining a recess 212 using the bottle outer surface 210 and placing at least portions of the movable handle 70 generally within the recess 212 in the first position 94.

The foregoing discussion discloses and describes merely exemplary embodiments. Upon review of the specification, one of ordinary skill in the art will readily recognize from such discussion, and from the accompanying figures and claims, that various changes, modifications and variations can be made therein without departing from the spirit and scope of the inventions as defined in the following claims.

What is claimed is:

1. An-apparatus, comprising:

a closure, the closure configured to be substantially sealingly secured to a bottle to retain contents within the bottle; and a movable handle, the movable handle hingedly attached to the closure, the movable handle indexably positionable between at least a first position and a second position, the movable handle in the first position adapted to be received at least in part within a recess defined by a portion of a bottle outer surface of the bottle with at least a portion of the first surface defined by the movable handle biased against at least a portion of the portion of the bottle outer surface that defines the recess, the closure including:

a base ring, a cap, and a flange ring, the base ring disposable about a bottleneck of the bottle generally between a flange and an aperture defined by the bottleneck, the cap engaged with the base ring along a frangible breakline, the cap adapted to be threadedly secured to the bottleneck of the bottle to generally sealingly secure contents within the bottle, the flange ring circumferentially disposable about the bottleneck of the bottle generally between the flange and a bottle shoulder of the bottle such that the flange retains the flange ring upon the bottleneck; and the movable handle hingedly attached to the flange ring.

2. The apparatus, as in claim 1, further comprising:

a closure includes a base ring and a cap, the base ring disposable about a bottleneck of the bottle generally between a flange and an aperture defined by the bottleneck, the cap engaged with the base ring along a frangible breakline, the cap adapted to be threadedly secured to the bottleneck of the bottle to generally sealingly secure contents within the bottle; and the movable handle hingedly attached to the base ring.

3. The apparatus, as in claim 2, further comprising:

a stop block, the stop block secured to a portion of the base ring, the stop block defining a first click point and a second click point;

a stop defined by a portion of the movable handle, the stop configured to engage the stop block at the first click point when the movable handle is generally in the first position, and the stop configured to engage the stop block at the second click point when the movable handle is in the second position.

4. The apparatus, as in claim 1, further comprising:

a stop block, the stop block secured to a portion of the closure, the stop block defining a first click point and a second click point;

a stop defined by a portion of the movable handle, the stop configured to engage the stop block at the first click point when the movable handle is generally in the first position, and the stop configured to engage the stop block at the second click point when the movable handle is in the second position.

5. The apparatus, as in claim 1, further comprising:

a stop block, the stop block secured to a portion of the flange ring, the stop block defining a first click point and a second click point; and a stop defined by a portion of the movable handle, the stop configured to engage the stop block at the first click point when the movable handle is generally in the first position, and the stop configured to engage the stop block at the second click point when the movable handle is in the second position.

6. The apparatus, as in claim 5, further comprising:

the movable handle hingedly attached to the closure by a hinge configured as a living hinge.

7. The apparatus, as in claim 5, further comprising:

the movable handle hingedly attached to the closure by a hinge configured as a pinned hinge.

8. The apparatus, as in claim 5, further comprising:

the movable handle configured to define at least one loop.

9. The apparatus, as in claim 5, further comprising:

the movable handle includes a carabiner.

10. The apparatus, as in claim 5, further comprising:

the movable handle includes a clip.

11. The apparatus, as in claim 5, further comprising:

the movable handle configured to define a hook proximate a second end.

12. An apparatus, comprising:

a bottle, the bottle defines an outer bottle surface, portions of the outer bottle surface define a recess;

a closure secured to the bottle, the closure includes a base ring, a cap, and a flange ring, the base ring disposed about a bottleneck of the bottle generally between a flange and an aperture defined by the bottleneck, the cap engaged with the base ring along a frangible breakline, the cap adapted to be threadedly secured to the bottleneck of the bottle to generally sealingly secure contents within the bottle, the flange ring circumferentially disposed about the bottleneck of the bottle generally between the flange and a bottle shoulder of the bottle such that the flange retains the flange ring upon the bottleneck; and a movable handle, the movable handle hingedly attached to the flange ring, the movable handle indexably positionable between at least a first position and a second position, the movable handle in the first position adapted to be received at least in part within the recess.

13. The apparatus, as in claim 12, further comprising:

a stop block, the stop block secured to a portion of the flange ring, the stop block defining a first click point and a second click point;

a stop defined by a portion of the movable handle, the stop configured to engage the stop block at the first click point when the movable handle is generally in the first position, and the stop configured to engage the stop block at the second click point when the movable handle is in the second position.

14. The apparatus, as in claim 12, wherein the bottle is comprised of plastic and the recess is formed in a blow-molding process.

15. The apparatus, as in claim 1, further comprising a clip attached to the movable handle.

16. The apparatus, as in claim 1, further comprising a clip including a fasteners to allow the movable handle to be secured.

17. The apparatus, as in claim 1, further comprising a clip attached to the apparatus, the clip including at least one fastener to allow the apparatus to be secured.

18. The apparatus, as in claim 1, further comprising a carabiner attached to the movable handle.

19. The apparatus, as in claim 12, further comprising a carabiner attached to the movable handle.

20. The apparatus, as in claim 1, wherein the movable handle further comprises a surface oriented away from a bottle outer surface.

21. The apparatus, as in claim 12, wherein the movable handle further comprises a surface oriented away from a bottle outer surface.

* * * * *